US005735643A

United States Patent [19]

Castonguay et al.

[11] Patent Number: 5,735,643

[45] Date of Patent: Apr. 7, 1998

[54] RETAINING WALL SYSTEM

[75] Inventors: Bertin Castonguay, Magog; Eric Milot, Montreal, both of Canada

[73] Assignee: Groupe Permacon Inc., Ville d'Anjou, Canada

[21] Appl. No.: 589,640

[22] Filed: Jan. 22, 1996

[30] Foreign Application Priority Data

Feb. 24, 1995 [CA] Canada ..... 2143379

[51] Int. Cl.[6] ..... E02D 29/04

[52] U.S. Cl. ..... 405/286; 52/606; 405/284

[58] Field of Search ..... 405/284, 285, 405/286; 52/603, 604, 608, 609, 611, 606

[56] References Cited

U.S. PATENT DOCUMENTS

| | | | |
|---|---|---|---|
| 4,193,718 | 3/1980 | Wahrendorf et al. | 405/286 |
| 4,920,712 | 5/1990 | Dean, Jr. | 52/169.4 |
| 4,964,761 | 10/1990 | Rossi | 405/286 |
| 4,997,316 | 3/1991 | Rose | 405/284 |
| 4,998,397 | 3/1991 | Orton | 405/286 X |
| 5,044,834 | 9/1991 | Janopaul, Jr. | 405/284 |
| 5,161,918 | 11/1992 | Hodel | 405/286 |
| 5,598,679 | 2/1997 | Orton et al. | 405/286 X |

FOREIGN PATENT DOCUMENTS

| | | |
|---|---|---|
| 1324266 | 11/1993 | Canada . |
| 0 490 168 | 6/1992 | European Pat. Off. . |
| 25 12 064 | 11/1975 | Germany . |
| 420677 | 12/1934 | United Kingdom . |
| 94/23136 | 10/1994 | WIPO . |

*Primary Examiner*—Dennis L. Taylor
*Attorney, Agent, or Firm*—Foley & Lardner

[57] ABSTRACT

A retaining wall kit is made up of a plurality of molded blocks, some having different thicknesses and some having different lengths. Keyhole-slots may be provided at the rear face of the molded blocks, each keyhole being proportionally sized inwardly of the rear face of the block such that a retaining member fitted within the keyhole-slot projects downwardly from the one molded block to engage the rear face of an adjacent molded block so as to space the molded blocks in a regular sloped position such that the inter section of the front and top faces of each molded block is in a common plane.

19 Claims, 13 Drawing Sheets

RETAINING WALL SYSTEM

BACKGROUND OF THE INVENTION

1. Field of the Invention

The present invention relates to a retaining wall system, and more particularly to a kit of molded concrete blocks, having different dimensions, for assembling a retaining wall.

2. Description of the Prior Art

There are many patents which relate to retaining walls made of molded concrete blocks and some are described, for instance, in U.S. Pat. No. 4,193,718 Wahrendorf et al and Canadian Patent 1,324,266 Ratté et al issued Nov. 16, 1993.

All of these prior art retaining walls are made up of molded blocks having constant thicknesses. Thus, even though the longitudinal dimensions of a block might vary, as shown in the Ratté et al patent, the thicknesses of such blocks are generally constant in order to have an orderly progression of rows of blocks.

SUMMARY OF THE INVENTION

It is an aim of the present invention to allow a sloped retaining wall to be constructed with blocks of different thicknesses, thereby giving the retaining wall a more natural appearance. Since such retaining walls are made to simulate stone retaining walls, such appearance is enhanced by having molded blocks of different longitudinal and vertical dimensions.

It is a further aim of the present invention to provide a kit for a retaining wall and a method for manufacturing such a kit.

It is a further aim of the present invention to provide an improved method of assembling a retaining wall utilizing blocks of different sizes.

A construction in accordance with the present invention comprises a kit for assembling a retaining wall wherein the kit is made up of a predetermined number of blocks. Each block has the form of a right rectilinear prism having an X axis in the longitudinal direction, a Y axis in the width direction, and a Z axis perpendicular to the X and Y axes. At least two blocks of the kit have different dimensions in the X axis. The dimensions in the Z axis of the first and second blocks may also be different. The dimension in the Y axis is constant.

A method in accordance with the present invention comprises the steps of first providing a mold having a mold area defined by the mold sufficiently large to mold a concrete slab representing a plurality of block modules; pouring concrete into said mold; curing the concrete slab; fractionating the slab along predetermined longitudinal fractionating lines to form individual block modules having right prism shapes and different dimensions at least in the longitudinal axis of some block modules.

In a further more specific version of the method, block modules of one slab having a predetermined thickness are mixed with block modules of another slab having a different thickness in order to form a kit for assembling a retaining wall.

Another aspect of the present invention includes a concrete slab for forming concrete blocks for a retaining wall comprising a right rectilinear prism having parallel top and bottom surfaces, opposed end walls and opposed parallel side walls, a first fractionating line extending parallel to the longitudinal axis of the prism from one end wall to the other and bisecting the prism. At least one second fractionating line extends, parallel to the transverse axis of the prism, from the first fractionating line to one of the opposite side walls.

More specifically, a third fractionating groove extends between one of the side walls on the same side of the first fractionating groove and one of the end walls to form the base of a right angled triangle with the one end wall and the one side wall.

At least four concrete blocks can be formed by fractionating the slab along the first and second fractionating lines and one of the four blocks, containing the third fractionating line can be converted into a block having an angled end wall for the purpose of forming a curved retaining wall, by fractionating the block along the third fractionating groove.

Reference to the term slab in the present specification refers to the formation of the multiple block module in a single molding operation and in a single mold, whether or not formed as one piece or in several parts corresponding to the block modules.

A construction in accordance with another aspect of the present invention comprises a kit for forming a sloped retaining wall, the kit including at least two blocks, each block having top and bottom parallel planar faces and front, rear, and end faces, each block having at least one opening extending from at least one of the bottom, end or top surface and at right angles to the surface from which it extends. The opening is near the rear face. A retaining member is included in the kit and has a first portion adapted to fit in the opening, and a second portion adapted to extend from the one opening and projects beyond one of the top and bottom surfaces when the retaining member is inserted in the opening so that the second portion engages the rear face of the other block vertically adjacent one of the top or bottom surfaces.

In a more specific embodiment of the present invention, the opening is defined in the block as a through passage in the form of a keyhole-slot having a cylindrical bore and a neck portion opening to the rear face of the block. The retaining member includes a cylindrical portion adapted to fit in the head of the keyhole and a shank portion adapted to fit in the narrow neck portion and project from one of the top and bottom surfaces of the block, such shank including an abutment surface at right angle to the top and bottom surfaces of the block.

BRIEF DESCRIPTION OF THE DRAWINGS

Having thus generally described the nature of the invention, reference will now be made to the accompanying drawings, showing by way of illustration, a preferred embodiment thereof, and in which.

Figure 1:
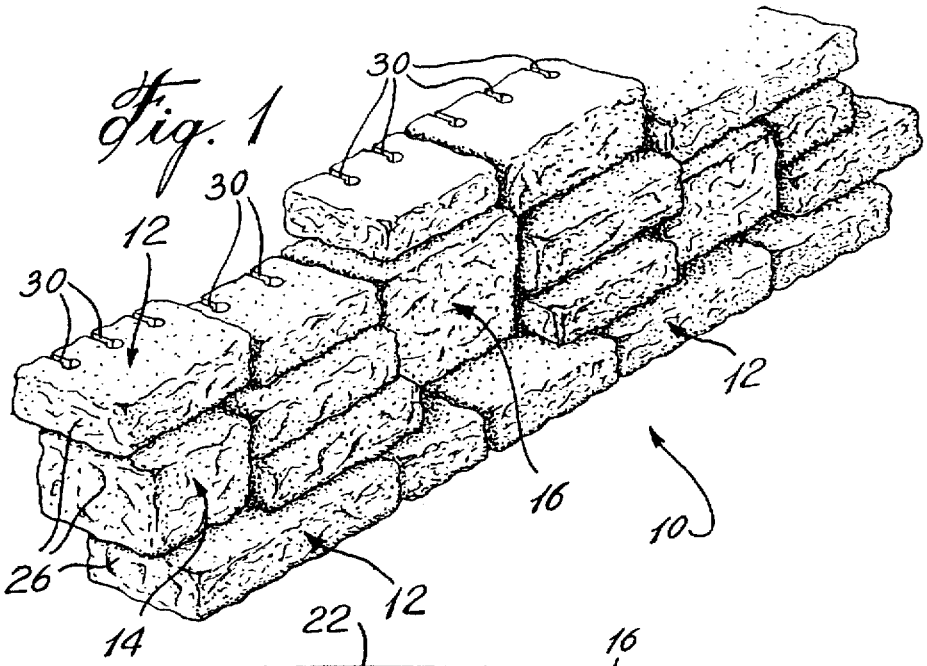
FIG. 1 is a perspective view of a portion of a retaining wall erected in accordance with the kit of the present invention.
Figure 2:
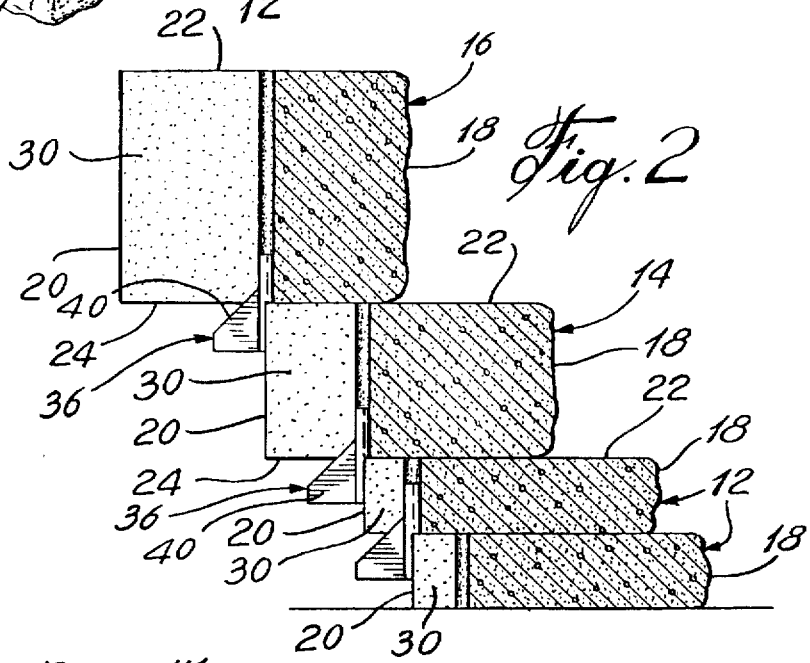
FIG. 2 is a vertical cross-section taken through a retaining wall.
Figure 5:
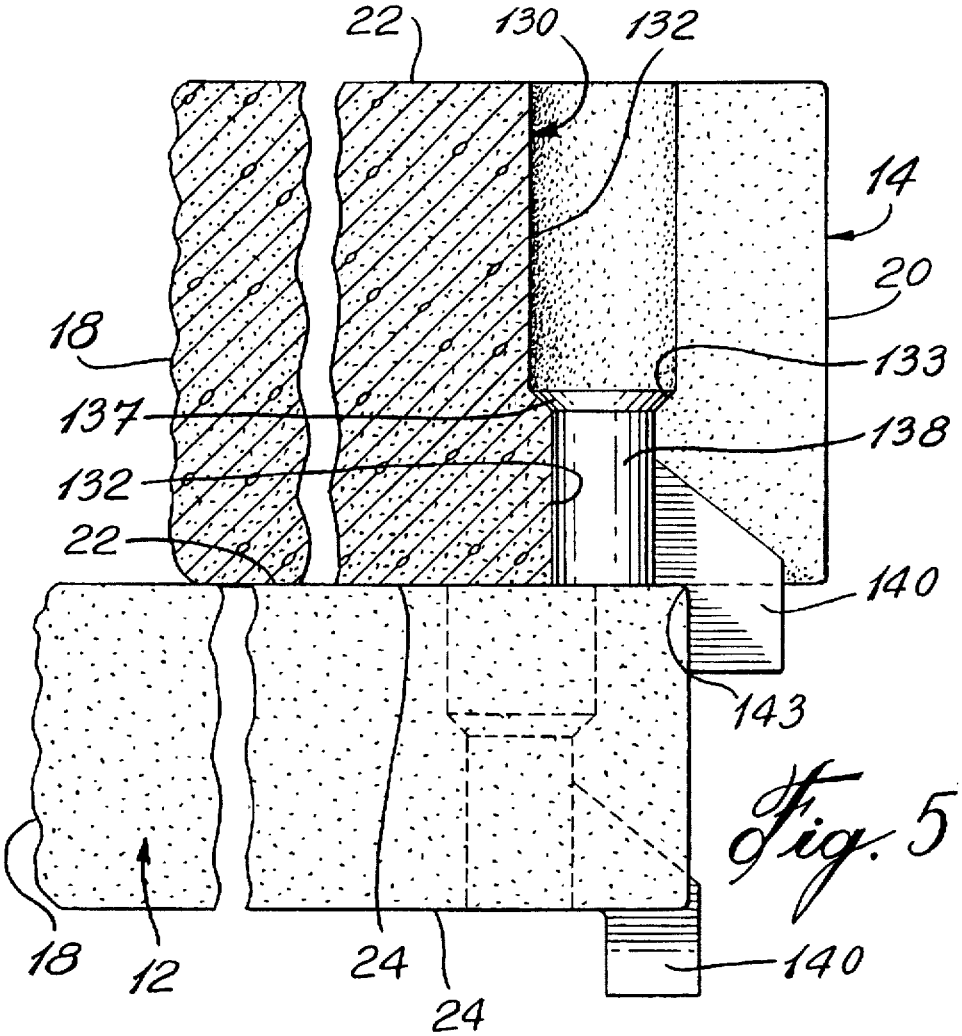
Figure 7:
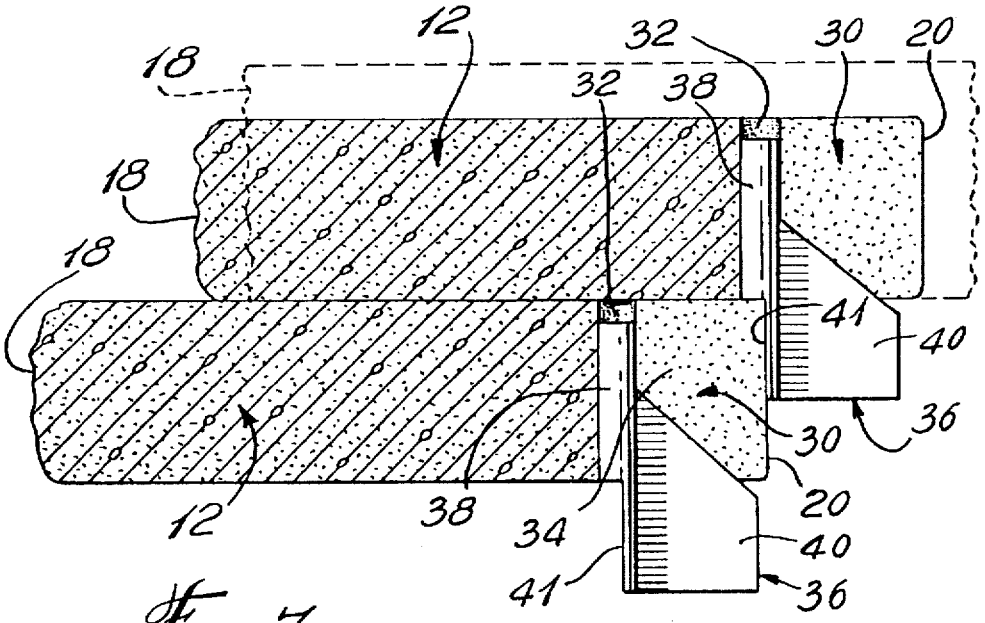
Figure 8A:
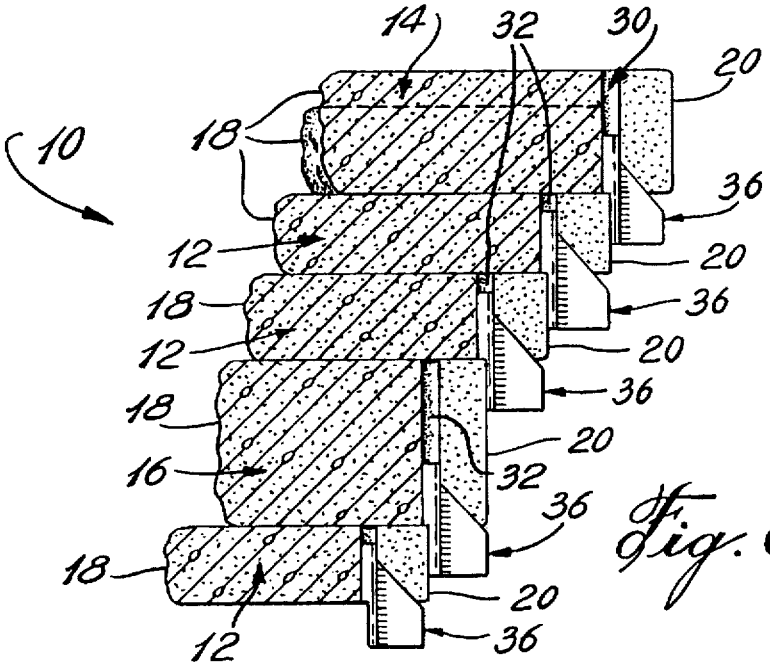
Figure 8B:
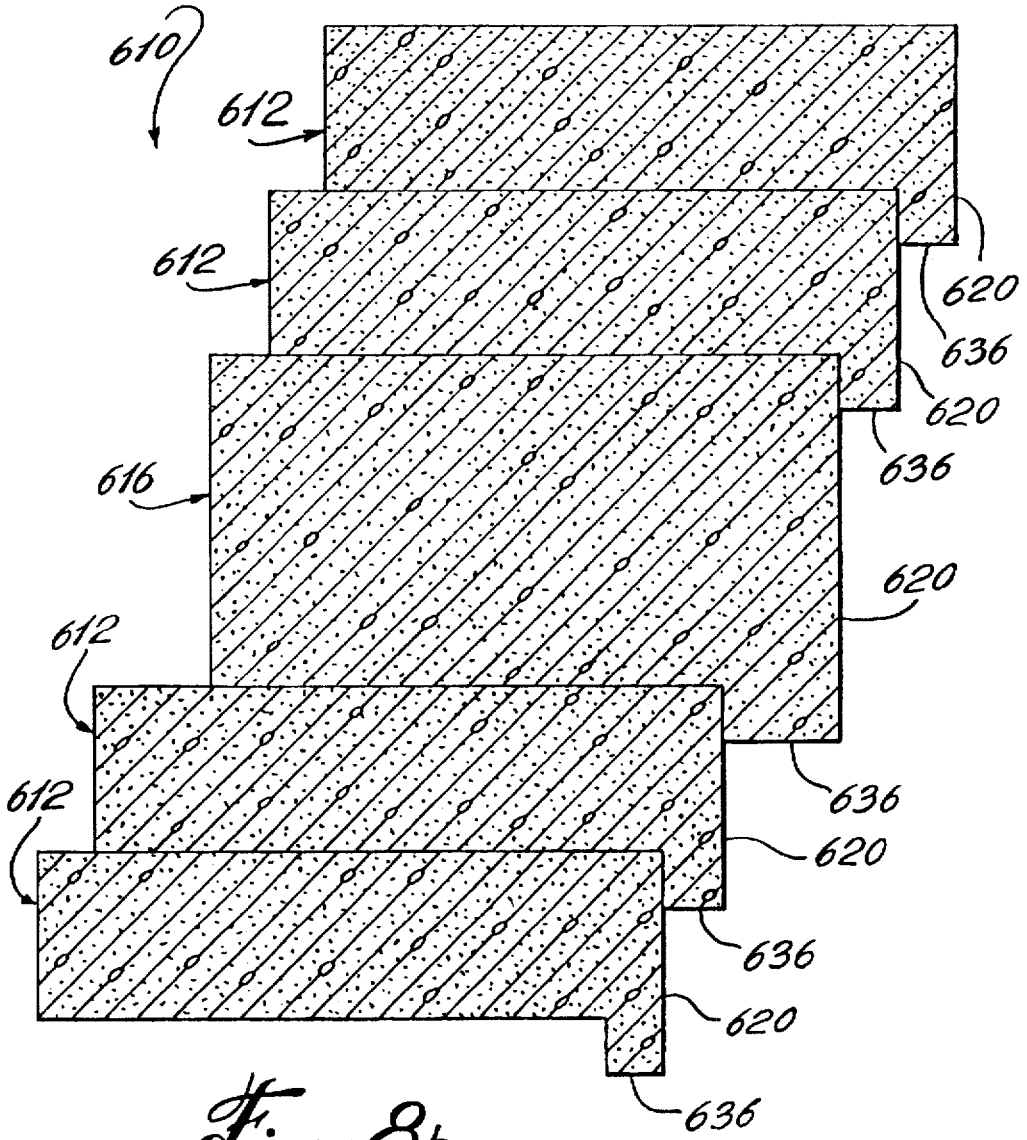
Figure 9:
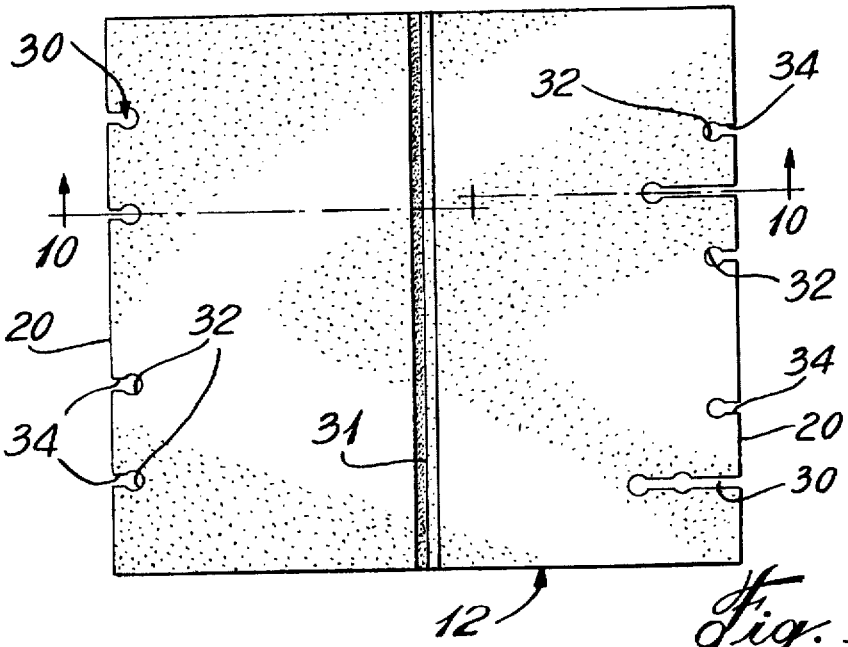
Figure 10:
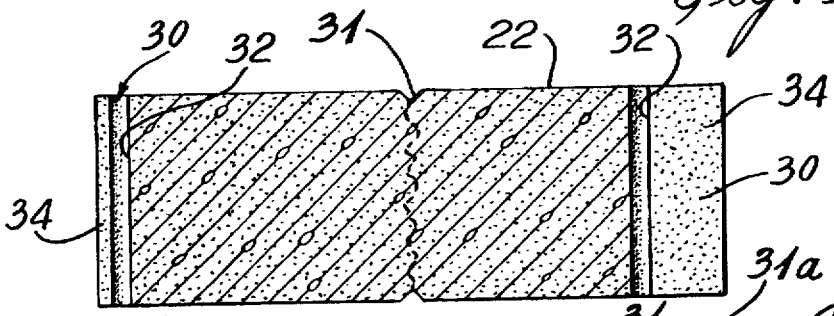
Figure 10A:
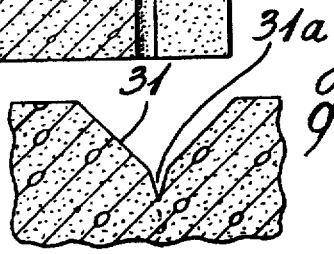
Figure 11:
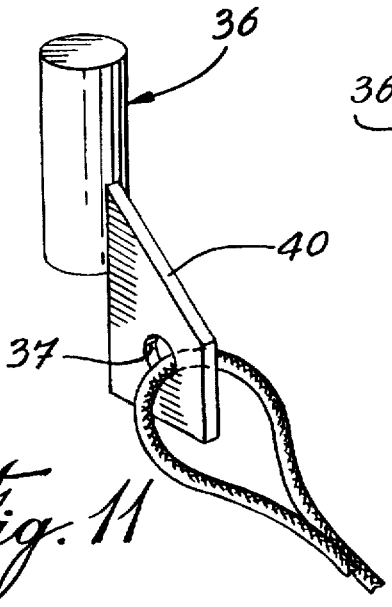
Figure 12:
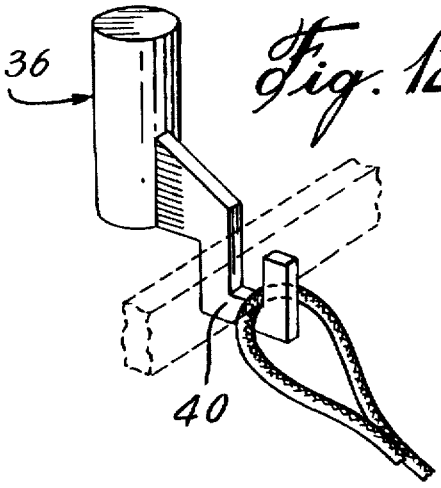
Figure 13:
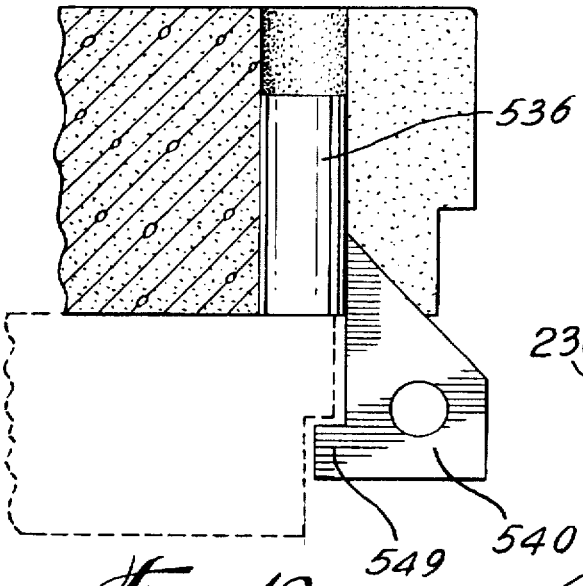

FIGS. *4a* and *4b* are front and rear elevations, respectively, of a partially assembled retaining wall showing a different arrangement from FIG. 1;

FIG. 5 is an enlarged fragmentary cross-section of a feature of the present invention;

FIGS. *6a*, *6b*, and *6c* are perspective views of different embodiments of the retaining member of the present invention;

FIG. 7 is an enlarged fragmentary view of a detail shown in FIG. 2;

FIG. 8*a* is a vertical cross-section showing another array of molded blocks forming a sloped retaining wall with the retaining devices;

FIG. 8*b* is a vertical cross-section showing an array of molded blocks forming a sloped retaining wall according to a further embodiment;

FIG. 9 is a top plan view of a molded concrete block cast forming two molded blocks face to face in one piece;

FIG. 10 is a vertical cross-section taken along lines 10—10 of FIG. 9;

FIG. 10*a* is a fragmentary enlarged vertical cross section of a detail in FIG. 10;

FIG. 11 is a still further embodiment of the retaining member;

FIG. 12 is yet another embodiment of the retaining member;

FIG. 13 is an enlarged fragmentary cross-section view showing yet another embodiment of the kit in accordance with the present invention.

Figure 15:
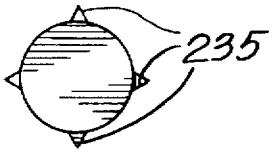
Figure 14:
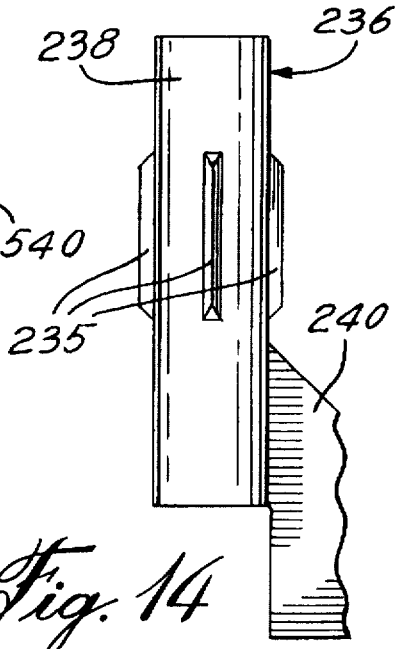
Figure 17:
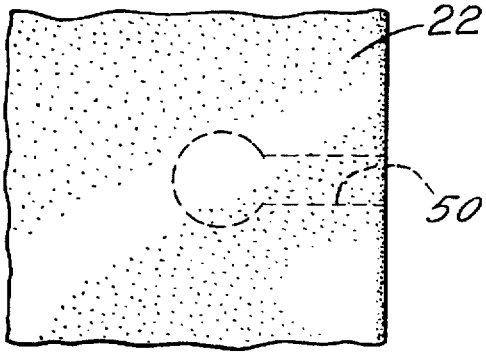
Figure 16:
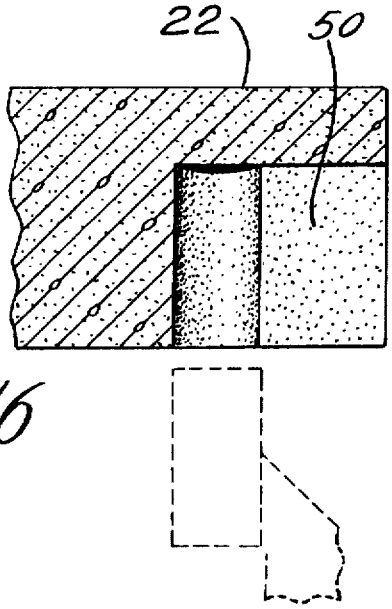
Figure 18:
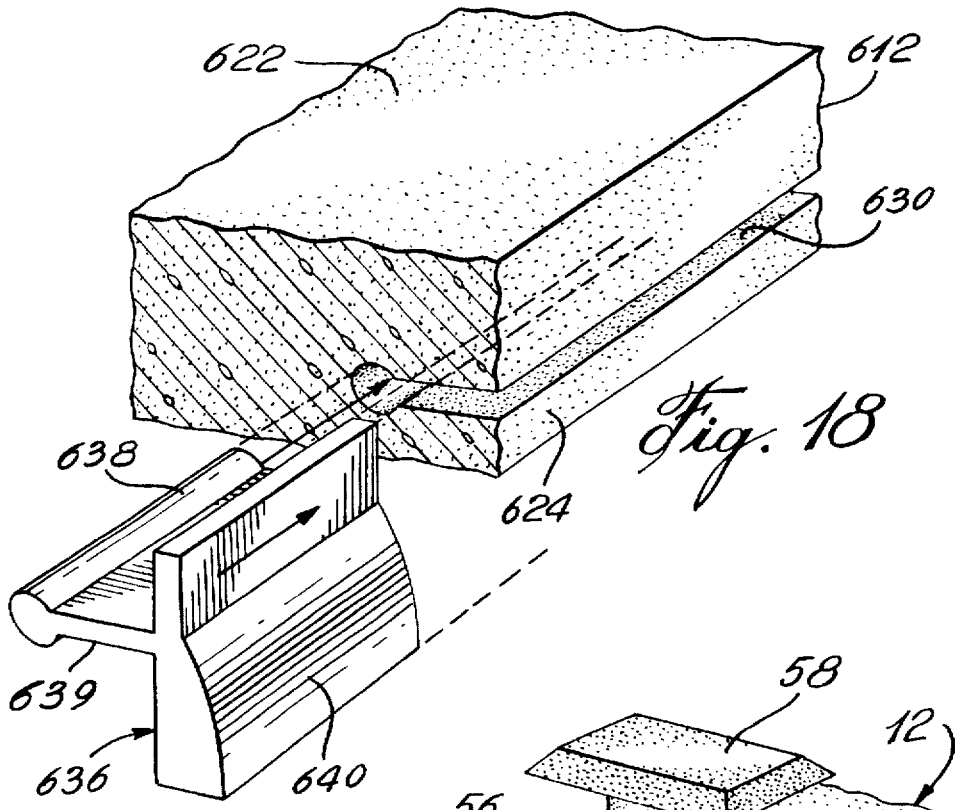
Figure 19:
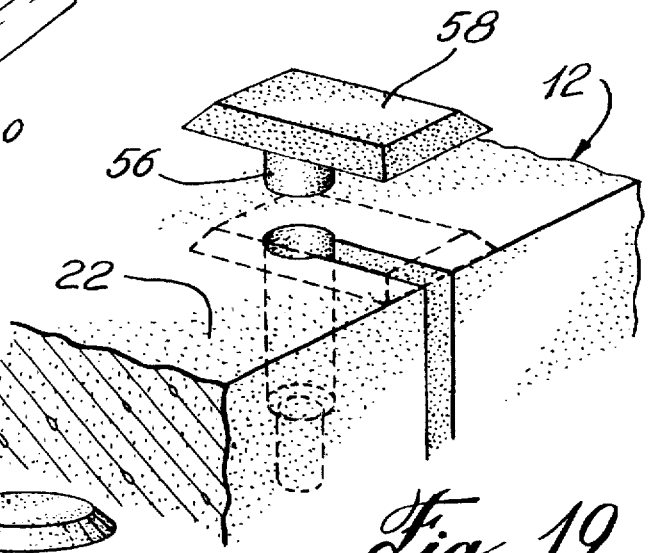
Figure 20:
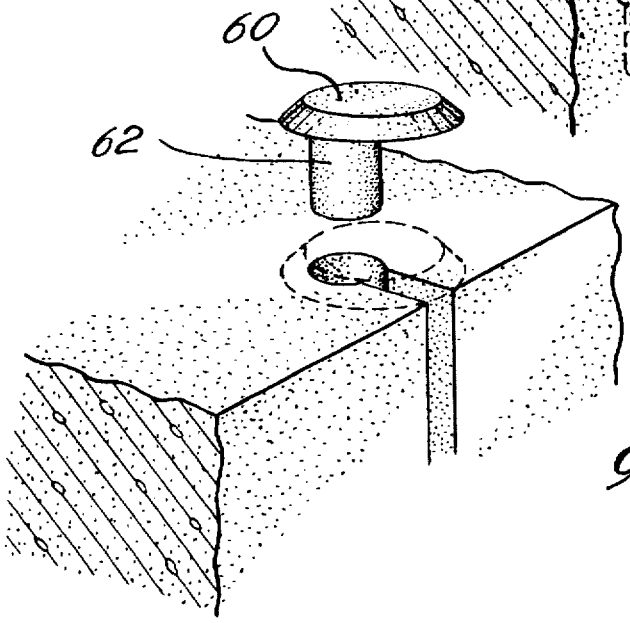
Figure 21:
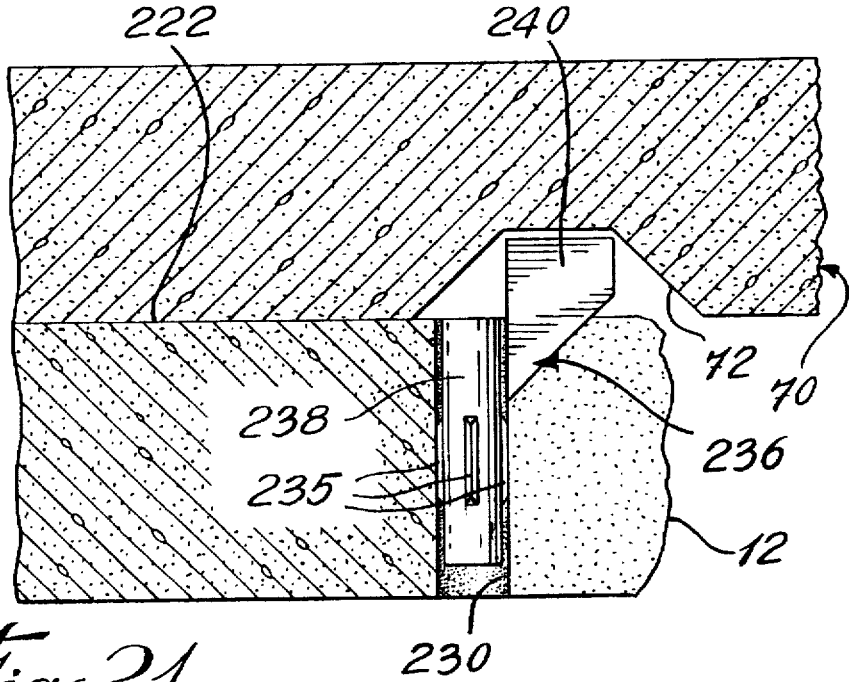
Figure 22:
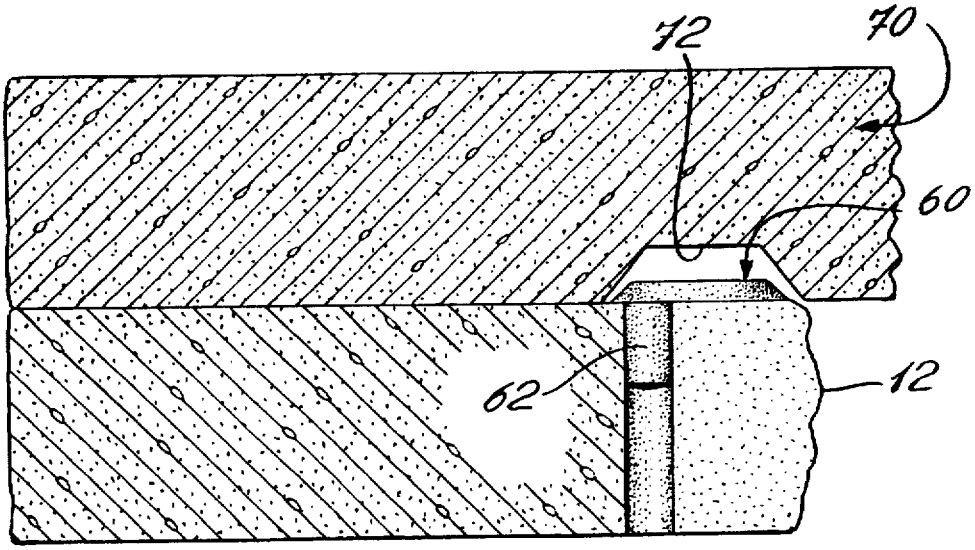
Figure 23:
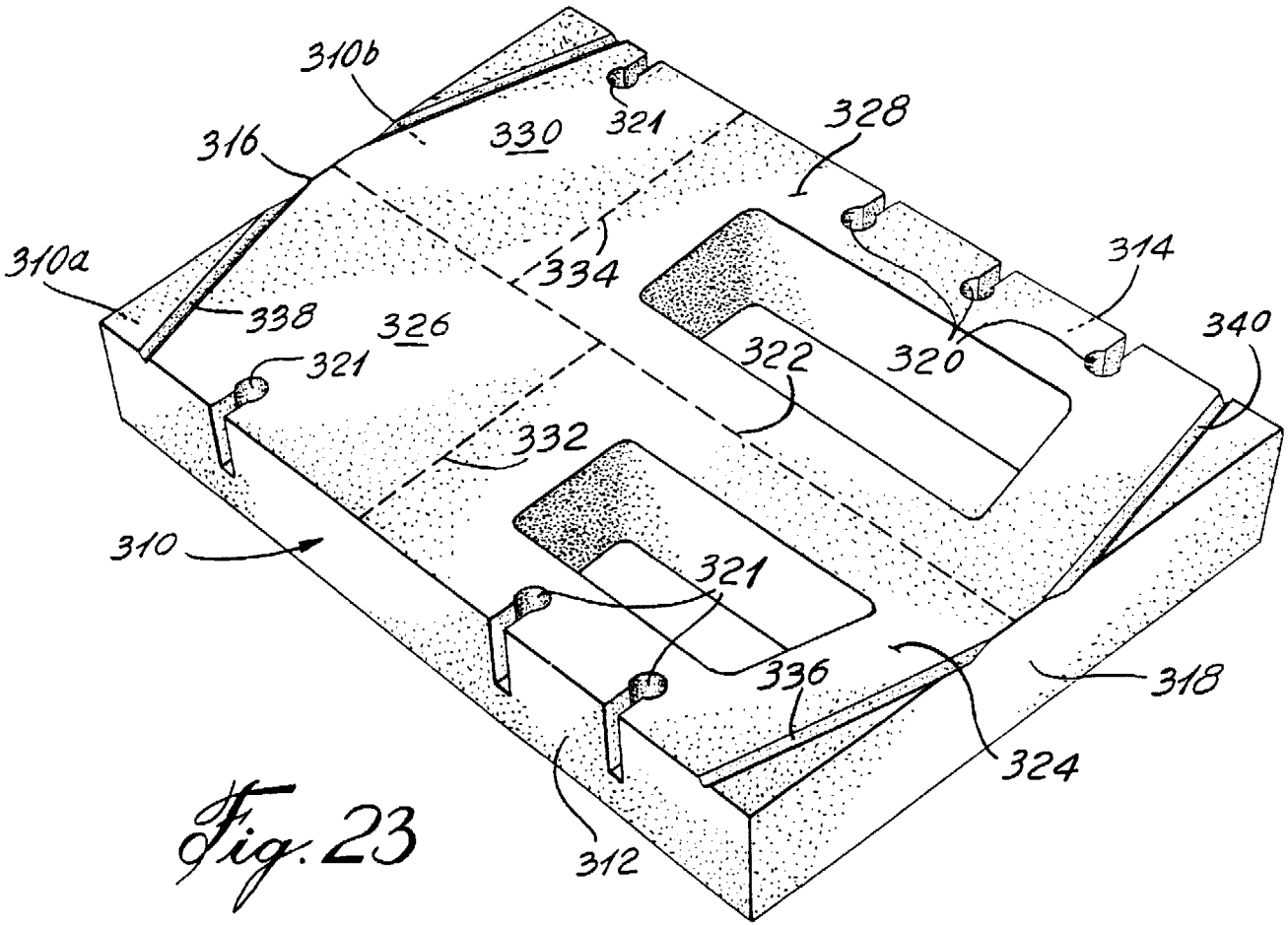
Figure 25:
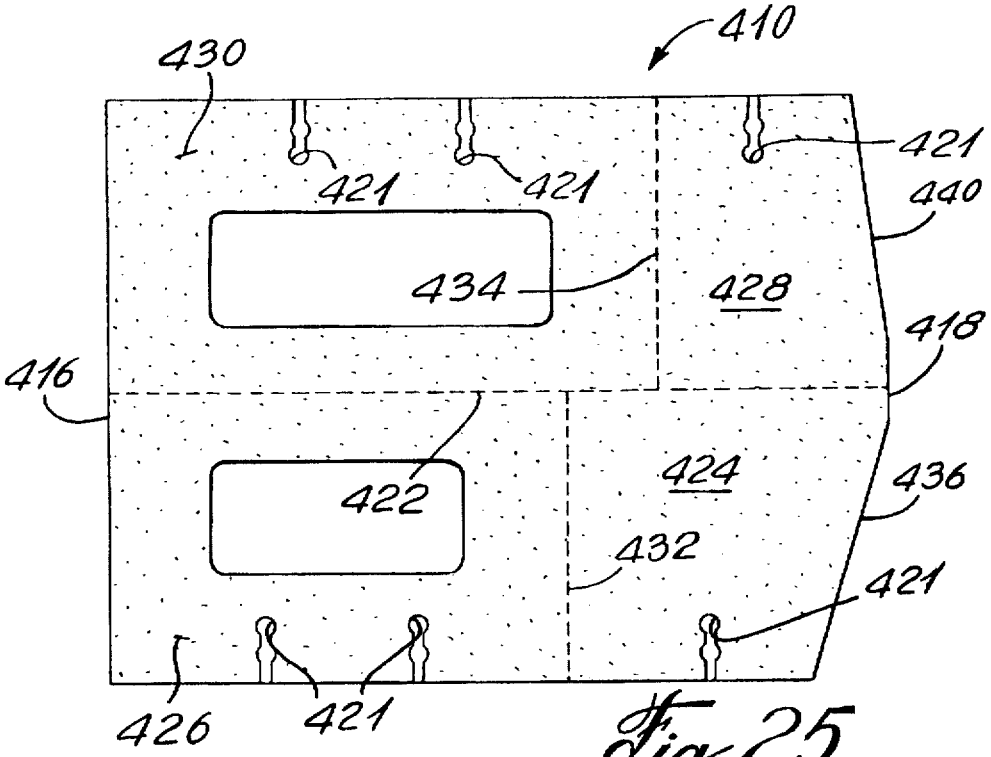
Figure 24:
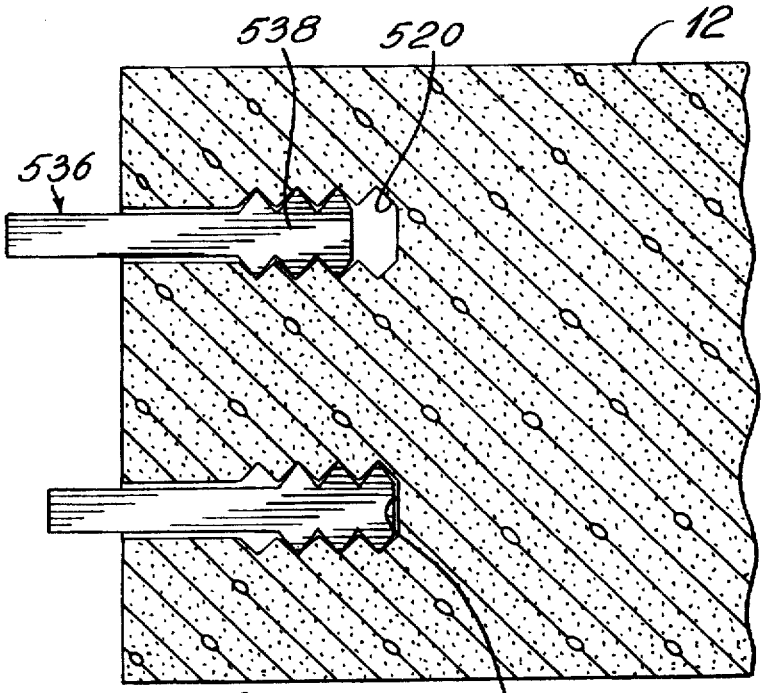
Figure 26:
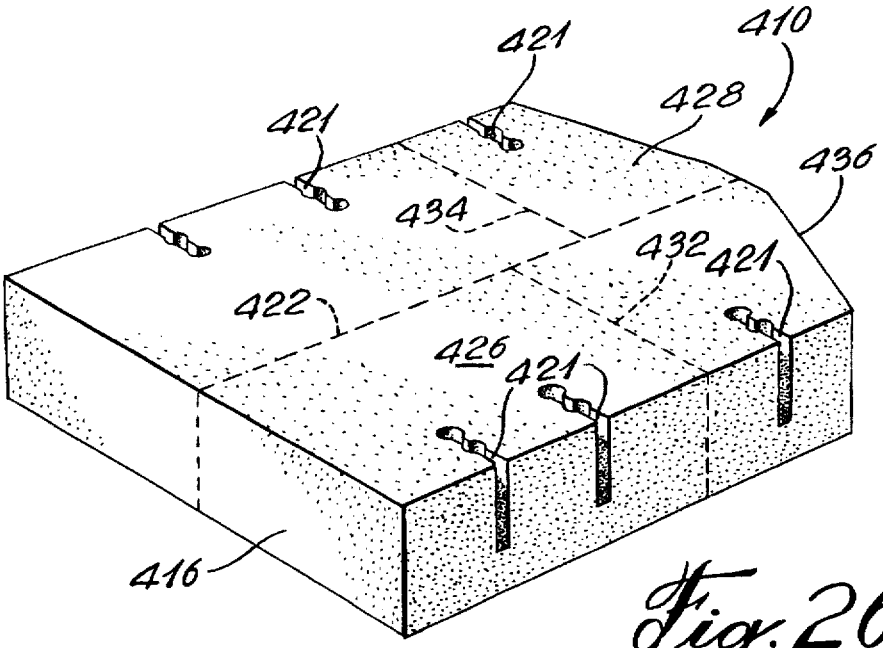
Figure 27:
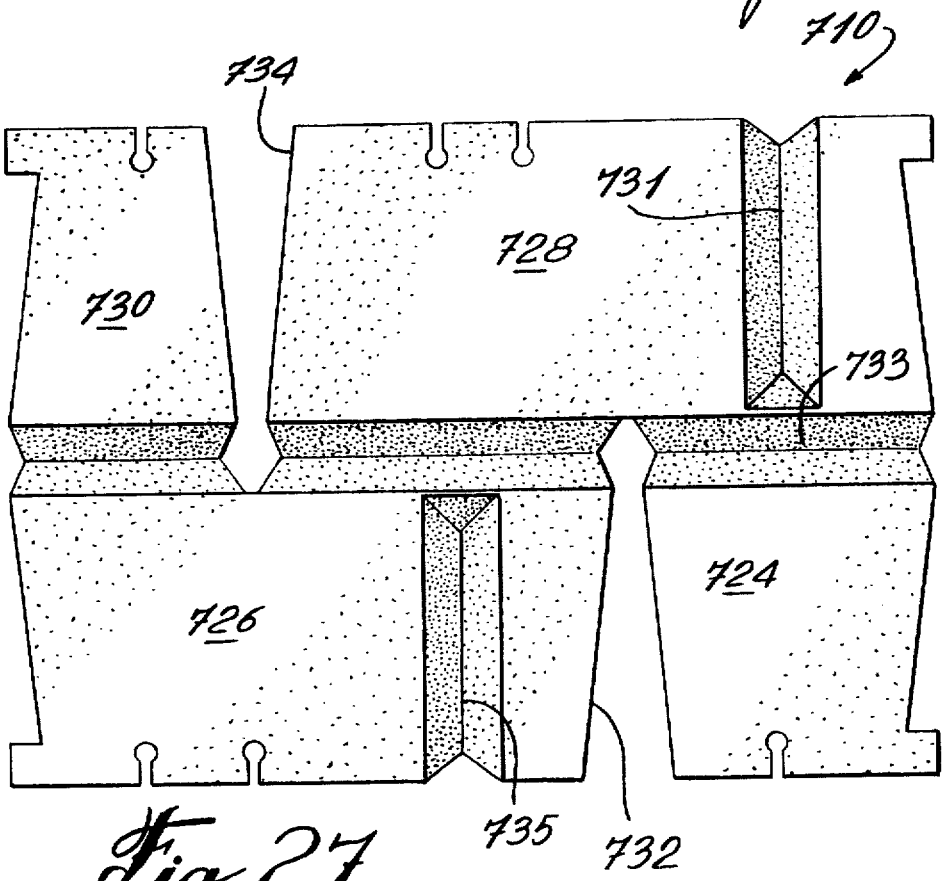
Figure 28:
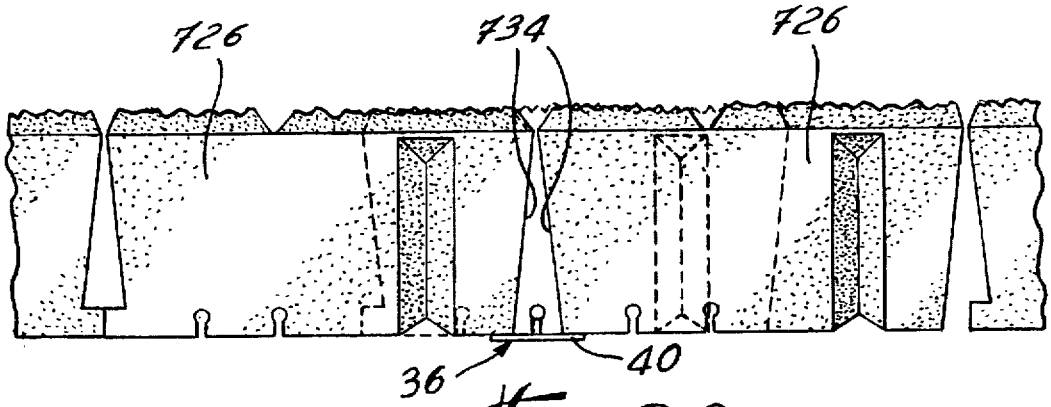
Figure 29:
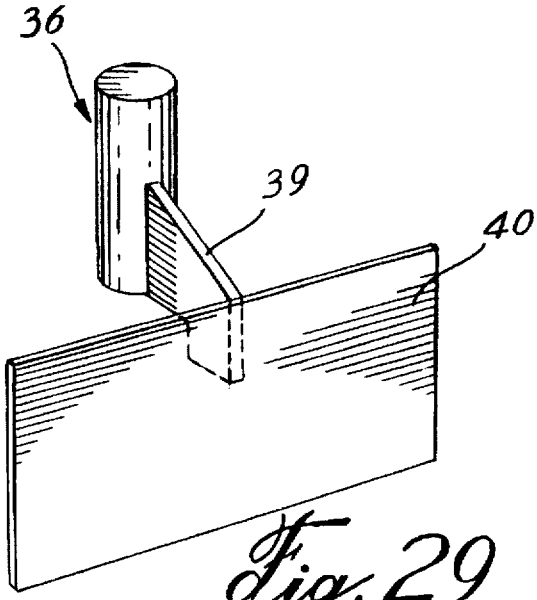

FIG. 14 is a fragmentary side elevation of the retaining member showing yet another embodiment thereof;

FIG. 15 is a top plan view thereof;

FIG. 16 is an enlarged fragmentary cross-section showing another embodiment of a molded block in accordance with the present invention;

FIG. 17 is a top plan view of the fragment of the block shown in FIG. 16;

FIG. 18 shows still a further embodiment of a kit in accordance with the present invention;

FIG. 19 is an exploded perspective view showing an element useful for a capping member of a retaining wall;

FIG. 20 is an exploded perspective view showing another embodiment of the feature shown in FIG. 19;

FIG. 21 is a side elevation partly in cross-section of a detail shown in FIG. 14 in another operative position;

FIG. 22 is a side elevation partly in cross-section showing the detail in FIG. 20 in association with a crown block;

FIG. 23 is a perspective view of a slab in accordance with one embodiment of the present invention;

FIG. 24 is an enlarged fragmentary horizontal cross-section taken through a detail of an anchor slot and an anchor member according to a still different embodiment thereof;

FIG. 25 is a top plan view of a slab in accordance with another embodiment of the present invention;

FIG. 26 is a perspective view of the slab shown in FIG. 25;

FIG. 27 is a top plan view of another embodiment of the slab in accordance with the present invention;

FIG. 28 is a fragmentary top plan view of a row of a retaining wall showing blocks whose end walls have been angled and the special retaining member used therewith shown in dotted lines; and FIG. 29 is a perspective view of a retaining member for use with the embodiment of FIG. 28.

DESCRIPTION OF THE PREFERRED EMBODIMENTS

Referring now to the drawings, and in particular to FIGS. 1 and 2, a retaining wall 10 is shown made up of molded concrete blocks 12 of a predetermined thickness with blocks 14 being of a greater thickness and blocks 16 having still a further greater thickness.

Each block 12, 14, or 16 has a front face 18, a rear face 20, a top surface 22, and a bottom surface 24. The block includes end surfaces 26. Each of the blocks 12, 14, 16 includes one or more keyhole-slots 30. Each keyhole-slot 30, as shown in FIG. 9 for instance, includes a circular cylindrical bore 32 and a neck portion 34.

Figure 6C:
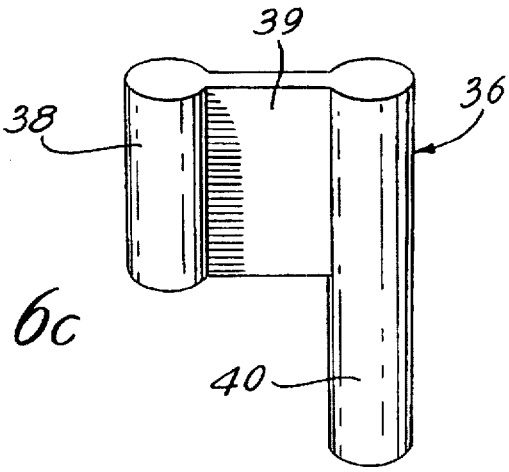
Figure 6B:
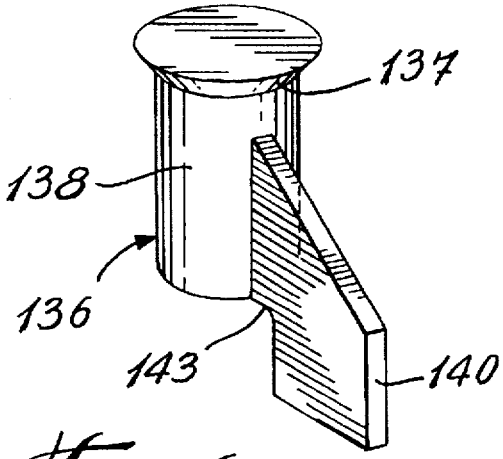
Figure 6A:
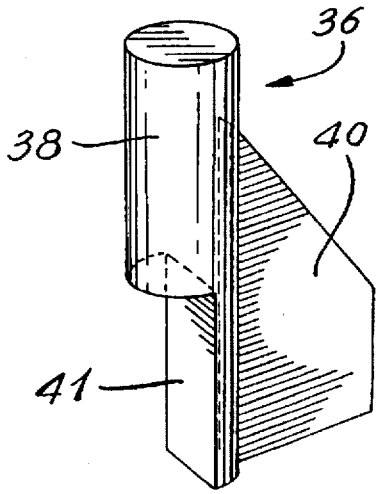

A retaining member 36, as shown in FIG. 6*a*, includes a stem portion 38 of circular cylindrical outline, and a shank portion 40 depending from the stem portion 38. In the embodiment of FIG. 6*a* the shank portion includes an extension of a segment of the cylindrical stem portion forming an abutment surface 41. This abutment surface is at right angle to the bottom surface 24 of the block when installed. As shown in FIG. 2 the retaining member 36 fits into the keyhole-slot 30 and projects below the bottom surface 24 as shown. The shank member 40 including abutment surface 41 abuts against the rear surface of an adjacent lower block 12 or 14. The retaining member acts both as a spacer and a retainer for the laying of the molded blocks 12, 14, and 16, in constructing the retaining wall 10.

Figure 3:
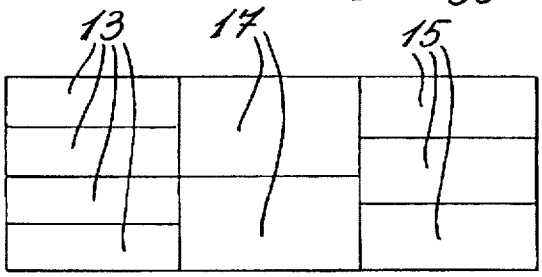
FIG. 3 is a schematic view showing different thicknesses of a molded block in accordance with the present invention.

As seen in FIG. 3, the molded blocks 13, 15, and 17 have different thicknesses. In this example three categories of thickness have been illustrated as exemplified by block 13 which measures 65 mm., block 15 which measures 86.7 mm., and block 17 has a thickness of 130 mm.

As shown in FIGS. 1, 2, and 8*a*, the retaining wall should have a slope in order to retain the backfill behind the retaining wall. This is especially true when laying such molded blocks without mortar. In order that the retaining wall be topped off with a crown, the slope must be constant even though different thicknesses of blocks are being used. By aligning the corners at the intersections of the front face 18 and the top face 22, so that they are in the same sloped plane, the retaining wall will have a consistency such that the top surface of the retaining wall can be aligned longitudinally and in the same plane in order to receive a crown.

In order to achieve this alignment, it is necessary to configure the keyhole-slots 30 such that the keyhole-slots extend further inwardly of the block from the rear wall 20, then in a shallower block 12. For example, and as shown in FIGS. 2 and 5, the extent of the keyhole-slots 30 measured from the rear face 20 is twice as great in molded block 14 as it is in molded block 12. The keyhole-slot 30 in molded block 16 has an inward dimension which is proportionally greater than that shown in molded blocks 14 or 12.

The retaining members 36 are identical and are placed with a cylindrical portion snugly fitted into the bore 32 with a shank partly within the slotted neck portion 34, and projecting downwardly so that it will engage the rear face 20 of an adjacent block.

FIG. 8*b* shows an array of blocks 612 and 616 forming a retaining wall 610. In this embodiment the retaining members 636 are integrally molded as part of the block near the rear wall 620 projecting from the bottom wall with an abutment surface 641 spaced from the rear wall proportionally to the thickness of the block.

Figure 4A:
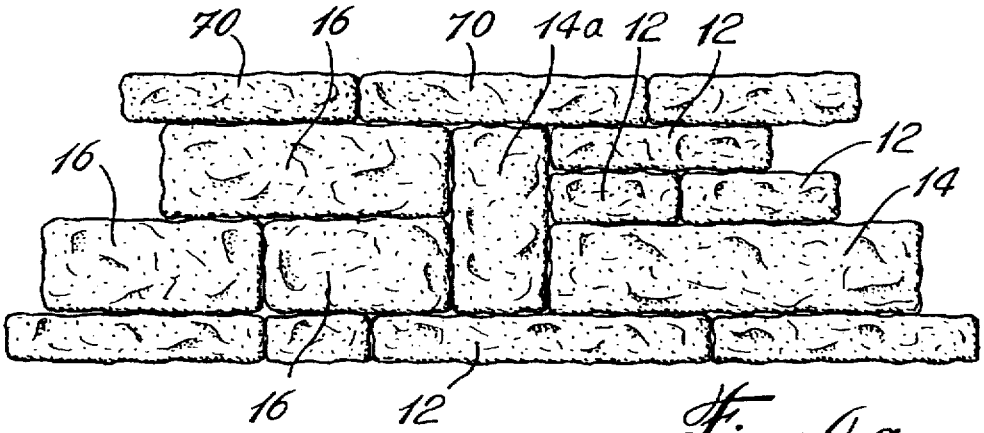
Figure 4B:
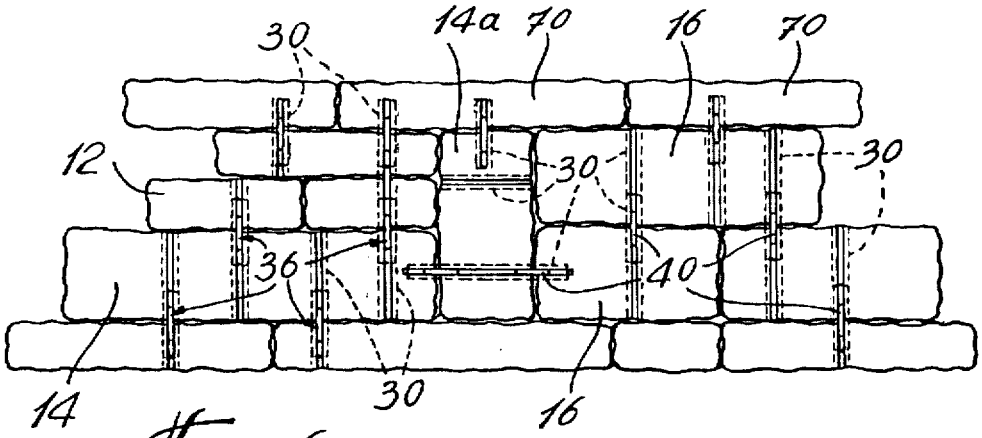

FIGS. 4*a* and 4*b* show an arrangement were one of the molded blocks 14 is placed in a vertical orientation as a jumper 14*a*. As seen in these figures the jumper 14*a* should have a length in the X axis (the length is shown in the vertical orientation in the case of FIGS. 4*a* and 4*b*) such that the length is a multiple of the thickness of certain of the blocks used in the arrangement (along the Z axis). In certain cases where several thicknesses are utilized it would be sufficient for the length of the jumper block 14*a* to be equal to the sum of the thicknesses of the other blocks. Thus a jumper 14*a* can be utilized, in the present embodiment, with a combination of two molded blocks 16 laid one on top of the other, or a combination of blocks 12 and 14. In lower profile walls, the jumper 14*a* may be useful in ensuring that the crown blocks 70 are in a common plane. Since jumper 14*a* is selected from a block 14, which would be supplied in the kit of blocks for building the retaining wall, it is obvious that the keyhole-slots 30 will no longer have a vertical orientation. Accordingly, in order to provide the proper slope or stagger for the retaining wall and the position of the jumper 14*a* in the retaining wall only the keyhole-slots in the lower portion of the jumper 14*a*, as shown in FIG. 4*b*, would be utilized while the other slots 30, in the upper portion of the jumper 14*a*, would remain empty. Thus retaining members 36 having abutment extensions 40 can extend from the lower portion of the jumper 14*a* to engage the rear surfaces of adjacent blocks, thereby staggering the jumper 14*a* from the bottom thereof so that it is properly aligned at the top portion of the blocks.

FIGS. 9 and 10 show a pair of blocks which are molded in one piece. Rear faces 20 of these blocks 12 are formed with keyhole-slots 30, each having a bore 32 and a slotted neck 34. In FIG. 9 different sizes of keyhole-slots 30 have been shown for purposes of illustration only. The blocks may have one or more keyhole-slots 30. The molded pair is fractured along fractionating groove 31 in order to form two blocks.

In order to properly fractionate the slab, the groove must form a V angle of less than 90 degrees. On the other hand a narrow groove leaves a less than attractive beveled surface on the block formed by fractionating the slab.

It is therefore desirable to provide a groove having an angle of 90 degrees or more. However such a groove will not provide a guarantee that, the split by means of fractionating, will occur in the groove, in view of the relative shallowness of the resulting groove. The slab may be split in an erratic manner unless the slab is fractionated with a special tool, set in the groove.

It has been found that, in accordance with the present invention, a sub groove may be located within the groove to insure that the slab will always be split along the desired fractionating line. As shown in FIG. 10*a*, the groove 31 is provided with a sub groove 31*a* at the apex thereof. Thus the groove 31 may have an angle of more than 90 degrees while the sub groove 31*a* will have an angle of less than 90 degrees. It has been found that the slab might merely be struck anywhere with a hammer blow and the fractionating line or split will occur consistently along the sub groove 31*a*.

FIG. 6*b* shows another embodiment of the present invention wherein the retaining member 130 is provided with a shoulder 137 formed on the cylindrical stem 138. The shank 140 includes a downward portion which is spaced from the tubular member 138 as shown at 143. The retaining member 138 is illustrated in FIG. 5 wherein the keyhole-slot has been altered to receive the particular retaining member 136. The keyhole-slot 130 includes a bore 132 and a frusto-conical shoulder 133 with the lower portion of the bore 132 being of smaller diameter. The retaining member 136 will sit in the bore 132 with the shoulder 137 sitting on the frusto-conical shoulder 133. This configuration insures that the retaining member is properly located in the keyhole-slot 130.

FIG. 6*c* shows a further embodiment of the retaining member 36 which can be used in the keyhole-slots 30. In this case, the retaining member has a first circular cylindrical stem 38, a web 39, and a further circular cylindrical abutment member 40 which projects beyond the web. In installation it is this extension of the circular cylindrical abutment member 40 which will extend beyond the block.

In FIG. 14, the retaining member 236 includes wings 235 which are slightly deformed when the cylindrical portion 238 is inserted in the corresponding bore 32 of the keyhole-slot 30, so as to reduce the chances of accidental displacement of the retaining member.

FIGS. 11 and 12 show two versions of the retaining member to which anchor ties can be accommodated. In FIG. 11 the retaining member 336 includes an opening 337 in the shank 340.

In FIG. 12 the retaining member 436 includes a hook-shaped shank 440.

FIG. 13 shows a still further embodiment of a retaining member adapted to be used with a molded block having a locking groove. In this case the stem 536 includes a shank 540 with a short projection 549 adapted to engage the groove in the adjacent block.

FIGS. 17 and 18 show a molded block to be used as a crown in which the keyhole-slot 50 extends only part-way through the block so that the top surface of the block 22 is uniform and uninterrupted.

FIG. 18 shows a keyhole that extends longitudinally of the block 612. The keyhole-slot 630 is parallel to the top surface 622. The retaining member 636 shown in FIG. 18 has a cylindrical bead member 638, a web portion 639, and a shank 640 which is adapted to project below the bottom surface 624 of the molded block.

FIGS. 19 and 20 show different types of cap devices which could be used in the event a typical block 12, 14 or 16 is used as the capping member, so as to cover the keyhole-slot. The capping member includes a plug 56 with a cap portion 58 that is offset. FIG. 20 shows a similar device with a circular cap portion 60 and a stem portion 62.

Referring now to FIG. 21, a retaining member 236, as shown in FIG. 14, is utilized with the stem 238 inserted into the bore 230 of block 12 from the top surface 222 thereof. Thus, the shank 240 extends upwardly from the top surface of the block. A crown 70 can then be set on the top of the retaining wall where the block 12 in FIG. 21 is in the uppermost row. Crown block 70 is provided with a longitudinal groove 72 as is conventional, and thus the shank 240 can protrude within the groove 72 in order to retain the crown block 70.

Likewise, as shown in FIG. 22, the plug 62 with cap 60 can be utilized in relation to a crown block 70 to protrude within the groove 72, and thereby retain the crown block 70 against lateral movement.

It is also contemplated that, as shown in FIG. 22, the plug and cap 60 could replace the retaining member. In other words each block 12 would have a groove 72 on the bottom surface and a bore could be located in the block at a distance from the rear wall 20 proportional to the thickness of the block. The plug and cap 60 is then inserted into the bore and the cap extends into the groove, thereby locating and retaining the adjacent blocks.

It is also contemplated that for low retaining walls, that is for 500 mm. or less, it would not be necessary to have the retaining members as described above. However it would be considered part of the present invention to provide a kit for a retaining wall which would include a number of concrete blocks having different sizes to provide a more natural stone look to the retaining wall. It is contemplated that several concrete blocks of different lengths and thicknesses but with relatively constant width could be provided to build a retaining wall in the same manner as described above but without the connecting elements.

A process for preparing a kit for building a retaining wall has also been contemplated wherein the process includes molding a slab of concrete 310 (FIG. 23). The slab 310 can be molded as a one-piece slab in a typical concrete block molding unit which might include a platform and removable side walls. It can also be molded by using intermediate mold plates in the mold to separate the mold modules. Thus the slab may consist of several blocks separated one from the other but molded in one mold cycle. The slab 310 has a rectangular outline in one embodiment measuring 610 mm.× 460 mm. The slab 310 has side walls 312 and 314 and end walls 316 and 318. The slab may be provided with through keyhole-slots 320 and blind keyhole-slots 321 along the longitudinal edges and extending inwardly from the side wall 312 and 314. For instance in slab 310 the block module 328 would have through keyhole-slots 320 and blocks 324, 326 and 330 would have blind keyhole-slots 321. Thus block modules 324, 326 can be used as capping members by inverting the blocks.

A linear fractionating line 322 bisects the slab into two halves 310*a* and 310*b*. The fractionating line 322 extends parallel to the longitudinal axis X of the slab 310 from end wall 316 to end wall 318. In the present embodiment each slab half portion measures 230 mm. in width. The line 322 is imaginary since in most cases the slab will be fractionated at the plant by suitable cutting tools.

Each slab half 310*a* and 310*b* is then subdivided into concrete block modules 324, 326, 328 and 330. For instance slab half 310*a* is subdivided into blocks 324 and 326 by means of fractionating line 332 while slab half 310*b* is separated into two block modules 328 and 330 by means of fractionating line 334. Fractionating lines 332 and 334 are parallel to transverse axis Y and extend from fractionating line 322 to the end walls 310 and 314 respectively. Fractionating lines 332 and 334 are at right angles to the fractionating lines 322.

At least one surface of the slab, in this case the top surface, could be provided with fractionating lines in the form of grooves 322, 332 and 334.

On the other hand the slab 310 could be molded with a mold plate along fractionating line 332 and once out of the mold, a fractionating blade could be used, at the factory, to separate the block modules along fractionating lines 332 and 334.

In the present embodiment block 324 now measures 360 mm. in length by 230 mm. in width. Block 326 measures 250 mm.×230 mm. Block 328 measures 460 mm.×230 mm., while block 330 measures 150 mm. in length and 230 mm. in width.

The keyholes 320 are located such that once the slab has been fractionated each resulting block 324, 326, 328 and 330 is provided with keyholes which will be useful in the case of using the retaining members.

The block 324, in the present embodiment, may be provided with a fractionating groove 336 while block 326 is provided with a fractionating groove 338. Fractionating groove 336 extends from the end wall 318 to the side wall 312 at an obtuse angle to the axis X and in fact can be seen to form a right angle triangle between side walls 312, end wall 318, and the base of the triangle formed by a fractional groove 336. The block would not normally be separated at fractionating groove 336 unless it is required to form a curved radius in the retaining wall, in which case a number of blocks would be fractionated on site along a fractional line such as fractional groove 336, in order to provide an end face with an angle so that when merged with other blocks a radius or curve can be defined.

The block modules 326 and 328 could be fractionated along lines 338 and 340 respectively, as part of the mold cycle. Thus blocks 326 and 328 would be predetermined on the pallet as blocks to form convex curves in the retaining wall.

Slab 310 has a constant thickness, yet the kit may be made with blocks of different thicknesses. Accordingly a kit may be made up by blocks from selected slabs of different thicknesses.

FIG. 24 shows another embodiment of a key-hole slot wherein the openings 520 in a typical block 12 have an accordion configuration while the stem 538 of retaining member 536 has a similar but shorter configuration so that the retaining member can be adjusted to adapt within the keyhole-slot 520.

FIGS. 25 and 26 show another embodiment of a slab, in this case identified 410. The block modules 424 and 428 are already preformed with angular end walls 436 and 440 respectively. These blocks 424 and 428 can be utilized to form a curve in the retaining wall or could be used as any block 12, 14 or 16. The keyhole-slots 420 which pass through the thickness of the block module 430 and blind keyhole-slot 421 are shown with double bores. These double bore keyhole-slots permit the retaining member to be adjusted in terms of slope or stagger, either for a vertical wall or for a staggered wall.

It should be noted that in respect of the slabs 310 and 410, one of the block modules would preferably be selected such that the X axis dimension of that block module would be a multiple of the thickness of the block module. This enables any of the so formed block modules to be utilized as a jumper 14*a*.

Another embodiment of the slab 710 is shown in FIG. 27. In this embodiment the blocks 724, 726, 728, and 730 have slots such as slots 732 and 734 instead of dividing lines. The slots 732 and 734 intersect the groove 733 which is parallel to the X axis and bisects the slab 710. Thus, after the slab 710 has been molded it can be separated into four block modules immediately upon fractionating the slab along the groove 733. Slabs 726 and 728 have further grooves 731 and 735 which can be fractured on site by the installer in order to provide a block with an end surface at right angles to the front or rear surfaces.

The process further includes the step of preparing pallets on which the blocks are arranged in the pattern that should be utilized in building a retaining wall. Thus, assembling the retaining wall is rendered much easier, when the blocks have been predisposed on the shipping pallets. Many variations could be obtained from different predisposed arrangements on the pallets, including the provision of blocks of the same thickness, thus a slab could be fractionated and the block modules merely placed on a pallet. However it is to be noted that a retaining wall may be assembled by mixing blocks from any number of pallets.

In a construction of a retaining wall, various pieces might be necessary including a block which could act as a crown for the retaining wall, a crown which can act as an end or corner piece, etc.

The following is a table showing a selection of various blocks as they might be utilized in the constructions of a retaining wall.

| | wall block | arc and capping arc | left hand corner | right hand corner | straight capping block | corner capping | step block | jumper |
|---|---|---|---|---|---|---|---|---|
| 424 | ✓ | ✓ | | | | | ✓ | ✓ |
| 426 | ✓ | | ✓ | | ✓ | ✓ | ✓ | |
| 428 | ✓ | ✓ | | | | | ✓ | ✓ |
| 430 | ✓ | | | ✓ | ✓ | ✓ | ✓ | |

Referring to the slab in FIGS. 25 and 26 the following observations have been made in this particular embodiment:

At least two of the block modules have a length relationship where one block is 10% longer than the other block. For instance, if block 426 has a dimension in the longitudinal axis which is A, then block 430 has a length dimension in the longitudinal axis which is A+A/10.

If block 424 is selected as the jumper, then the length L of block 424 must be a multiple the height T of the slab in the Z axis. In other words, block 424 must have an L dimension equal to 2T, 3T . . . . nT.

At least one of the blocks such as blocks 426 or 430 has a right angle corner and a length 1 equal to a width w+L/5.

The width Y is constant for all of the blocks in the slab. At least one of the blocks in each slab must have an angle to the Y axis between 5° and 30°.

Each block in a slab has accommodation for retaining members.

FIGS. 28 and 29 show a typical row of blocks 726 for instance. Since the end walls 734 may be at an angle a special retaining member 36 can be utilized as shown in FIG. 29. The retaining member 36 has a stem 38, a shank 39, and a flat abutment plate 40. The abutment plate 40 should be large enough to bridge the gap formed by the diverting end walls 734 of adjacent blocks 726. Of course retaining member 36 shown in FIG. 28 extends downwardly from the row above.

Moreover, the description and illustration of the invention is by way of example, and the scope of the invention is not limited to the exact details shown or described.

We claim:

1. A kit for a retaining wall comprising:

at least two molded blocks adapted to be placed in a keyhole overlying position one to the other, each block having top, bottom, front, rear, and end faces, wherein the top and bottom faces are parallel, an opening extending into one of the blocks from one of the top, bottom, and end faces and parallel to the rear face, the key hole opening including a narrow slot extending toward the rear face, a retaining member adapted to be inserted into the opening, the retaining member including a stem portion to be fitted into the opening, and a narrow shank portion projecting partly in said slot and beyond one of the top and bottom faces, the shank having an abutment portion which is parallel to the rear face, the abutment portion of the shank portion being adapted to engage a rear face of the other of the blocks to retain the one block in relation to the other.

2. A kit for a retaining wall as defined in claim 1, wherein the opening includes a first portion having a predetermined diameter and a second portion having a diameter larger than the first portion, and forming a pilot hole, the retaining member includes a stem portion having longitudinal axis and a diameter similar to the diameter of the first portion and a flared cap portion fitting within the second portion of the opening; and the shank is a flat planar member extending below the bottom wall of the block, and is inserted into the opening and is offset from the longitudinal axis of the stem.

3. A kit for a retaining wall as defined in claim 1, wherein the opening is an elongated keyhole-slot having a cylindrical portion and a narrow neck portion extending to the rear face of the block, and the retaining member includes a cylindrical stem which fits into the cylindrical portion of the keyhole-slot, and the shank is a flat fin-like member offset from the stem and aligned in a plane intersecting a longitudinal axis of the cylindrical stem, the shank also having an abutment portion including an edge parallel to the longitudinal axis of the cylindrical component such that when the retaining member is fitted within the keyhole-slot, the shank extends beyond one of the top and bottom faces of the block, such that the abutment portion is adapted to engage a rear face of a vertical adjacent block to provide an offset to the overlying block and to provide the retaining wall with a slope.

4. A kit for a retaining wall as defined in claim 3, wherein the shank includes an aperture accommodating a tie means for an anchor.

5. A kit for a retaining wall as defined in claim 3, wherein the bottom face of a block is provided with a channel-shaped groove extending parallel to the X-axis, and the shank of the retaining member is provided at the abutment portion with a projection having a shape complementary to the channel-shaped groove, such that when the block overlies a vertically adjacent block, the projection in the abutment portion of the shank engages the groove of the adjacent block.

6. A kit for a retaining wall as defined in claim 3, wherein the stem includes deformable wings on an exterior surface thereof which provide a snug fit of the stem within the slot.

7. A kit for a retaining wall as defined in claim 3, wherein the opening extends from the bottom wall and is a blind opening such that the top surface is uninterrupted and the block can be used as a capping member for the retaining wall.

8. A kit for a retaining wall as defined in claim 3, wherein the opening extends from one of the end faces and the opening is a keyhole-slot with an enlarged head portion and a narrow neck portion which extend into the block from the rear face of the block, the retaining member includes a stem adapted to fit within the enlarged head of the keyhole-slot, a web portion extending from the stem and adapted to fit within the neck portion, and a flange extending perpendicular to the web, beyond one of the top and bottom faces, and the flange including an abutment portion adapted to engage a rear face of a vertically adjacent block.

9. A kit for a retaining wall as defined in claim 5, wherein at least one of the blocks is a capping member and has an elongated groove in the bottom face thereof, the groove extending between the end faces of the block spaced from the rear face thereof, and the capping member being adapted to overlie a vertically adjacent block of the kit, the vertically adjacent block including an opening that is a keyhole-slot extending from the top face of the block, and the retaining member being fitted into the keyhole-slot from the top face of the block with the shank projecting from the top face of the block and adapted to engage the groove of the capping member.

10. A kit for a retaining wall as defined in claim 1, wherein the opening extends between the top and bottom surfaces of the block, and a cap is provided which is insertable from the top surface of the block to cover the opening and therefore convert the block into a capping member.

11. A kit for a retaining wall as defined in claim 1, wherein the keyhole-slot includes a plurality of circular cylindrical portions interconnected by narrow neck portions which extend in a plane perpendicular to the rear face such that each cylindrical component is at a different distance from the rear face, and the retaining member can be set in one of said plurality of cylindrical components to one of increase and decrease the offset of adjacent vertical blocks.

12. A kit for a retaining wall as defined in claim 11, wherein the kit comprises plural concrete blocks, each block having an X-axis in a longitudinal direction which is parallel to the front and rear faces, a Y-axis perpendicular to the X-axis and a Z-axis perpendicular to the X- and Y-axes, and at least two blocks have different dimensions along the X-axis, and the retaining member and the corresponding opening being selected for use with adjacent blocks when a wall is being assembled with the blocks staggered to provide a slope with an intersection of the top and front face lying in a common plane, wherein the slope of the plane is between a vertical direction and 45° from the vertical direction.

13. A kit for assembling a retaining wall, wherein the kit comprises a predetermined number of concrete blocks, each block having parallel top, bottom, front, and rear faces, an X-axis in a longitudinal direction which is parallel to the front and rear faces, a Y-axis perpendicular to the X-axis, and a Z-axis perpendicular to the X- and Y- axes, wherein all of the blocks have equal dimensions along the Y-axis, at least two blocks have different dimensions along the X-axis, and at least two blocks have different dimensions along the Z-axis, wherein the kit also includes retaining members for use with adjacent blocks when the wall is being staggered to form a slope with an intersection of the top and front faces lying in a common plane, wherein the slope of the plane is between 0° and 45° from a vertical direction, and the retaining members is spaced from the rear face by a distance determined from the dimension of the blocks along the Z-axis.

14. A kit for a retaining wall as defined in claim 12, wherein said top and bottom faces intersect said rear face at right angles, and the opening extends into the block from one of the top and bottom faces, and is spaced from said rear face.

15. A kit as defined in claim 14, wherein the opening is a keyhole-slot extending from the rear face, and the distance that the keyhole-slot extends into the block from the rear face is determined by the dimension of the block in the Z-axis such that the greater the dimension of the block along the Z-axis, the greater the distance the keyhole-slot extends into the block from the rear surface.

16. A kit as defined in claim 15, wherein the dimension of the second block in the Z-axis is twice the dimension of the first block in the Z-axis, and the extent of the keyhole-slot from the rear face is proportional to the extent of the keyhole-slot from the rear face of the first block.

17. A kit as defined in claim 16, wherein an intersection of the top face and the front face of each block lies in a common sloped plane when the blocks of the kit are laid in an array to form a retaining wall with the retaining members set in the keyhole-slot of each block with the shanks of each retaining member extending from the bottom face of each block and abutting against the rear face of a vertically adjacent block.

18. A kit for assembling a retaining wall with a slope as defined in claim 13, wherein the top and bottom parallel faces intersect the rear face at right angles and the retaining members includes a projection extending from the bottom face and spaced from the rear face, the projection having an abutting surface to abut a rear face of an adjacent block when the blocks are arranged to form a retaining wall such that the projection facilitates staggering of the blocks to form a slope.

19. A kit for assembling a retaining wall as defined in claim 18, wherein the abutting surface of the projection is spaced from the rear wall proportional to the dimension of the blocks in the Z-axis such that when the blocks are arranged to form a retaining wall, a slope is formed with the intersections between the front and top surfaces being in a common plane.

* * * * *